US012398339B2

(12) United States Patent
Monjiyama et al.

(10) Patent No.: US 12,398,339 B2
(45) Date of Patent: Aug. 26, 2025

(54) LUBRICATING OIL COMPOSITION

(71) Applicant: NOF CORPORATION, Tokyo (JP)

(72) Inventors: Shunsuke Monjiyama, Nishinomiya (JP); Kazuhiro Oda, Nishinomiya (JP); Atsumi Urabe, Shinagawa-ku (JP)

(73) Assignee: NOF CORPORATION, Tokyo (JP)

( * ) Notice: Subject to any disclaimer, the term of this patent is extended or adjusted under 35 U.S.C. 154(b) by 0 days.

(21) Appl. No.: 18/854,199

(22) PCT Filed: Apr. 5, 2023

(86) PCT No.: PCT/JP2023/014057

§ 371 (c)(1),
(2) Date: Oct. 4, 2024

(87) PCT Pub. No.: WO2023/199812

PCT Pub. Date: Oct. 19, 2023

(65) Prior Publication Data

US 2025/0230377 A1 Jul. 17, 2025

(30) Foreign Application Priority Data

Apr. 14, 2022 (JP) ..... 2022-067151

(51) Int. Cl.

| | |
|---|---|
| ***C10M 169/00*** | (2006.01) |
| ***C10M 105/38*** | (2006.01) |
| ***C10M 129/76*** | (2006.01) |
| ***C10M 137/08*** | (2006.01) |
| ***C10M 141/10*** | (2006.01) |
| ***C10M 169/04*** | (2006.01) |
| *C10N 30/00* | (2006.01) |
| *C10N 30/06* | (2006.01) |
| *C10N 30/10* | (2006.01) |
| *C10N 30/12* | (2006.01) |
| *C10N 40/02* | (2006.01) |
| *C10N 40/08* | (2006.01) |
| *C10N 40/25* | (2006.01) |

(52) U.S. Cl.

CPC ..... *C10M 169/04* (2013.01); *C10M 105/38* (2013.01); *C10M 129/76* (2013.01); *C10M 137/08* (2013.01); *C10M 141/10* (2013.01); *C10M 2207/2835* (2013.01); *C10M 2207/288* (2013.01); *C10M 2223/043* (2013.01); *C10N 2030/06* (2013.01); *C10N 2030/10* (2013.01); *C10N 2030/12* (2013.01); *C10N 2030/64* (2020.05); *C10N 2040/02* (2013.01); *C10N 2040/08* (2013.01); *C10N 2040/25* (2013.01)

(58) Field of Classification Search

CPC ..... C10M 169/04; C10M 105/38; C10M 129/76; C10M 137/08; C10M 141/10; C10M 2207/2835; C10M 2207/288; C10M 2223/043; C10N 2030/06; C10N 2030/10; C10N 2030/12; C10N 2030/64; C10N 2040/02; C10N 2040/08; C10N 2040/25

See application file for complete search history.

(56) References Cited

U.S. PATENT DOCUMENTS

| | | | | |
|---|---|---|---|---|
| 2009/0176670 | A1* | 7/2009 | Kawasaki | C10M 169/04 508/177 |
| 2017/0198234 | A1* | 7/2017 | Matsuki | C10M 141/10 |
| 2019/0225908 | A1 | 7/2019 | Nagase et al. | |
| 2020/0308502 | A1* | 10/2020 | Kawamoto | C10M 105/42 |

FOREIGN PATENT DOCUMENTS

| | | | |
|---|---|---|---|
| JP | 2011-140643 | A | 7/2011 |
| JP | 2015-147859 | A | 8/2015 |
| JP | 2016-104858 | A | 6/2016 |
| JP | 2017-186529 | A | 10/2017 |
| JP | 2020-510116 | A | 4/2020 |
| WO | WO 2017/217299 | A1 | 12/2017 |
| WO | WO 2018/038208 | A1 | 3/2018 |

OTHER PUBLICATIONS

International Search Report mailed on Jun. 20, 2023 in PCT/JP2023/014057 filed on Apr. 5, 2023, 2 pages).

* cited by examiner

*Primary Examiner* — Taiwo Oladapo
(74) *Attorney, Agent, or Firm* — Oblon, McClelland, Maier & Neustadt, L.L.P.

(57) ABSTRACT

The present invention is a lubricating oil composition containing, per 100 parts by mass of (A) an ester compound of a neopentyl polyol having 5 to 10 carbon atoms and a valence of alcohol of 2 to 6 and a linear unsaturated fatty acid having 16 to 22 carbon atoms, 0.1 to 1.5 parts by mass of a specific (B) acid phosphate ester amine salt, 0.01 to 0.25 parts by mass of a specific (C) succinic acid monoester, and 0.01 to 0.25 parts by mass of (D)N-oleoylsarcosine. According to the present invention, it is possible to provide a lubricating oil composition which is excellent in biodegradability, lubricity (anti-wear property), and rust preventive property against seawater, which is low in toxicity and accumulation to aquatic organisms, and further which is excellent in oxidation stability even in the presence of seawater.

1 Claim, No Drawings

LUBRICATING OIL COMPOSITION

TECHNICAL FIELD

The present invention relates to a lubricating oil composition which is excellent in biodegradability, lubricity (anti-wear property), and rust preventive property against seawater, which is low in toxicity and accumulation to aquatic organisms, and further which is excellent in oxidation stability even in the presence of seawater. The present lubricating oil composition can be suitably used as a hydraulic oil, a bearing oil, or a gear oil, and particularly can be suitably used as a hydraulic oil used in a marine area.

BACKGROUND ART

In recent years, new efforts have been made worldwide to protect the environment, and the importance of lubricating oils capable of reducing the environmental load has increased. As a lubricating oil capable of reducing the environmental load, attention has been paid to a biodegradable lubricating oil which is easily decomposed in the natural world and has little influence on the ecological system even if it leaks. Various studies have been made on this biodegradable lubricating oil. For example, PTL 1 discloses a biodegradable hydraulic oil in which an antioxidant and a load resistance additive are blended in a base oil composed of a complex ester of a polyhydric alcohol, a linear saturated fatty acid, and a linear saturated polycarboxylic acid.

Most of biodegradable lubricating oils are used as countermeasures against leakage into rivers and oceans, and in some areas, the use of biodegradable lubricating oils is mandatory. For example, in Europe, the use of biodegradable lubricating oil is mandatory in two cycle engine oil for outboard motors used in lake areas, and hydraulic operating oil for construction machines used in the vicinity of rivers from which drinking water is collected. As such lubricating oil used in the vicinity of water shores, for example, PTL 2 discloses a water-soluble biodegradable lubricating oil using (poly)alkylene glycol as a base oil.

In the United States, it is mandatory to use a lubricating oil that is biodegradable and further has low toxicity and accumulation to aquatic organisms in marine lubricating oils used for ships operating in United State waters, and there is a demand for a lubricating oil that can further reduce the environmental load. As such a lubricating oil, for example, PTL 3 discloses a biodegradable lubricating oil having low toxicity and accumulation to aquatic organisms, in which various additives are blended in a base oil composed of trimethylolpropane triester.

On the other hand, since the above-described marine lubricating oil is very often used in the vicinity of the ocean, there are many opportunities for seawater to be mixed into the lubricating oil, and the marine lubricating oil is required to exhibit sufficient performance even when seawater is mixed into the lubricating oil. In particular, in the case of hydraulic oils for ships, since there is a possibility that metals in the equipment are corroded, high rust preventive property against seawater is required. In addition, the hydraulic oils are sometimes exposed to high temperatures, and it is desired that the hydraulic oils exhibit high oxidation stability even when seawater is mixed therein.

However, in the above-mentioned prior art, sufficient studies on the above-mentioned problems have not been made, and there has been a demand for a biodegradable lubricating oil which is low in toxicity and accumulation to aquatic organisms, and is excellent in rust preventive property against seawater and oxidation stability even in the presence of seawater.

CITATION LIST

Patent Literature

PTL 1: JP 2015-147859 A
PTL 2: JP 2017-186529 A
PTL 3: JP 2020-510116 A

SUMMARY OF INVENTION

Technical Problem

As described above, an object of the present invention is to solve the above-described problems, and more specifically, to provide a lubricating oil composition which is excellent in biodegradability, lubricity (anti-wear property), and rust preventive property against seawater, has low toxicity and low accumulation to aquatic organisms, and further is excellent in oxidation stability even in the presence of seawater.

Solution to Problem

As a result of intensive studies to solve the above-described problems, the present inventors have found that the above-described problems can be solved by blending an ester compound (A) of a specific alcohol and a linear unsaturated fatty acid having 16 to 22 carbon atoms, a specific acidic phosphate ester amine salt (B), a specific succinic acid monoester (C), and N-oleoylsarcosine (D) at a specific ratio.

That is, the present invention is as follows.

A lubricating oil composition containing, per 100 parts by mass of the following (A) an ester compound, 0.1 to 1.5 parts by mass of (B) an acidic phosphate ester amine salt, 0.01 to 0.25 parts by mass of (C) a succinic acid monoester, and 0.01 to 0.25 parts by mass of (D)N-oleoylsarcosine:

(A): an ester compound of a neopentyl polyol having 5 to 10 carbon atoms and a valence of alcohol of 2 to 6 and a linear unsaturated fatty acid having 16 to 22 carbon atoms;

(B): an acidic phosphate ester amine salt represented by the following formula (1)

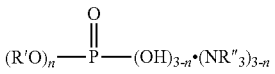

$$(R'O)_n-\overset{\overset{\displaystyle O}{\|}}{P}-(OH)_{3-n}\cdot(NR''_3)_{3-n} \quad (1)$$

in which n is an integer of 1 or 2, R' is a linear alkyl group having 4 to 6 carbon atoms, and R" is a hydrogen atom or an alkyl group having 11 to 14 carbon atoms;

(C) a succinic acid monoester which is a monoesterified product of a succinic acid having a hydrocarbon group having 8 to 18 carbon atoms and an alkanediol having 3 to 8 carbon atoms.

Advantageous Effects of Invention

The lubricating oil composition of the present invention is excellent in biodegradability, lubricity (anti-wear property), and rust preventive property against seawater, low in toxicity and accumulation to aquatic organisms, and further excellent in oxidation stability even in the presence of seawater, and therefore can be suitably used as a hydraulic oil, a bearing oil, or a gear oil, particularly a hydraulic oil used in a marine area.

DESCRIPTION OF EMBODIMENTS

Hereinafter, embodiments of the lubricating oil composition of the present invention will be described in detail.

In the description herein, a numerical range defined by using the symbol "to" includes numerical values at both ends (upper limit and lower limit) of "to". For example, "2 to 5" represents 2 or more and 5 or less.

[Lubricating Oil Composition]

A lubricating oil composition of the present invention contains, per 100 parts by mass of (A) an ester compound, 0.1 to 1.5 parts by mass of (B) an acidic phosphate ester amine salt, 0.01 to 0.25 parts by mass of (C) a succinic acid monoester, and 0.01 to 0.25 parts by mass of (D)N-oleoylsarcosine.

< (A) Ester Compound>

The lubricating oil composition of the present invention contains (A) an ester compound, which will be described below. The ester compound (A) is an ester compound of a neopentyl polyol having 5 to 10 carbon atoms and a valence of alcohol of 2 to 6, and a linear unsaturated fatty acid having 16 to 22 carbon atoms.

As a raw material of the ester compound (A), a neopentyl polyol having 5 to 10 carbon atoms and a valence of alcohol of 2 to 6 is used because of its excellent oxidation stability and heat resistance. The neopentyl polyol is an alcohol having a neopentyl skeleton which does not have a hydrogen atom at the carbon at the β-position with respect to the hydroxy group. Examples of the divalent neopentyl polyol include neopentyl glycol, examples of the trivalent neopentyl polyol include trimethylolethane and trimethylolpropane, examples of the tetravalent neopentyl polyol include pentaerythritol, and examples of the hexavalent neopentyl polyol include dipentaerythritol. One of these neopentyl polyols may be used alone, or two or more of them may be used in combination.

Among the above neopentyl polyols, divalent to tetravalent neopentyl polyols are preferable, trivalent or tetravalent neopentyl polyols are more preferable, and trivalent trimethylolpropane and tetravalent pentaerythritol are particularly preferable.

When two or more kinds of the above-described neopentyl polyols are used in combination as the alcohol for forming the ester compound (A), it is preferable to use trivalent trimethylolpropane and tetravalent pentaerythritol in combination. That is, the ester compound (A) is preferably a combination of an ester compound of trimethylolpropane and a linear unsaturated fatty acid having 16 to 22 carbon atoms (ester of trimethylolpropane) and an ester compound of pentaerythritol and a linear unsaturated fatty acid having 16 to 22 carbon atoms (ester of pentaerythritol). By containing the ester compound (A) obtained by using these neopentyl polyols, the lubricity (anti-wear property) of the lubricating oil composition can be further enhanced. When trimethylolpropane and pentaerythritol are used in combination to prepare an ester of both, the mass ratio of the ester of trimethylolpropane to the ester of pentaerythritol is preferably 95/5 to 50/50, particularly preferably 95/5 to 60/40, and further preferably 95/5 to 70/30.

The linear unsaturated fatty acid having 16 to 22 carbon atoms in the present invention is a monocarboxylic acid having 16 to 22 carbon atoms, having a linear hydrocarbon chain, and having one or more double bonds in the molecule. Examples thereof include palmitoleic acid, oleic acid, elaidic acid, erucic acid, linoleic acid, and linolenic acid.

Among the above-described linear unsaturated fatty acids, oleic acid, linoleic acid, and linolenic acid are preferable, and oleic acid is more preferable. One of these fatty acids may be used alone, or two or more of them may be used in combination.

The fatty acid is usually commercially available as a fatty acid mixture (having a content of the linear unsaturated fatty acid of 60% by mass or more) in many cases, and thus may contain other fatty acids such as a saturated fatty acid and a branched fatty acid within a range that does not impair the effects. The content of the linear unsaturated fatty acid in the fatty acid mixture containing other fatty acids is preferably 60% by mass or more, more preferably 65% by mass or more, and particularly preferably 70% by mass or more.

The ester compound (A) can be produced by a known method such as a method in which neopentyl polyol and a linear unsaturated fatty acid are directly reacted with each other or a method in which the ester compound (A) is synthesized by ester exchange. In addition, after the esterification, for the purpose of removing unreacted linear unsaturated fatty acids, if necessary, a removal method such as distillation under reduced pressure or a washing treatment after alkali neutralization may be used.

The ester compound (A) preferably has a hydroxyl value of 5 to 50 mgKOH/g. By setting the hydroxyl value of the ester compound (A) to 5 mgKOH/g or more, the rust preventive property is further improved. On the other hand, by setting the hydroxyl value of the ester compound (A) to 50 mgKOH/g or less, the demulsification property is improved. From this viewpoint, the hydroxyl value of the ester compound (A) is more preferably 7.5 to 40 mgKOH/g, and particularly preferably 10 to 30 mgKOH/g. The hydroxyl value is measured in accordance with JIS K 0070.

The ester compound (A) preferably has a kinematic viscosity at 40° C. of 10 to 300 $mm^2/s$. By setting the kinematic viscosity of the ester compound (A) at 40° C. to 10 $mm^2/s$ or more, the lubricity (anti-wear property) is further improved. On the other hand, by setting the kinematic viscosity of the ester compound (A) at 40° C. to 300 $mm^2/s$ or less, the loss of energy due to the internal resistance of the lubricating oil itself associated with the high viscosity can be reduced, and the decrease in fuel consumption can be suppressed. From this viewpoint, the kinematic viscosity of the ester compound (A) at 40° C. is more preferably 15 to 200 $mm^2/s$, and still more preferably 20 to 150 $mm^2/s$. The kinematic viscosity is measured in accordance with JIS K 2283.

The ester compound (A) preferably has an acid value of 10.0 mgKOH/g or less. By setting the acid value of the ester compound (A) to be 10.0 mgKOH/g or less, it is possible to suppress a decrease in lubricity (anti-wear property) and oxidation stability. From this viewpoint, the acid value of the ester compound (A) is more preferably 5.0 mgKOH/g or less, still more preferably 3.0 mgKOH/g or less, and particularly preferably 1.0 mgKOH/g or less. The acid value is measured in accordance with JIS K 0070.

The content of the ester compound (A) in the lubricating oil composition of the present invention is not particularly limited, and is preferably 50% by mass or more, more preferably 80% by mass or more, and still more preferably 90% by mass or more, based on the total amount of the lubricating oil composition.

< (B) Acidic Phosphate Ester Amine Salt>

The lubricating oil composition of the present invention contains (B) an acid phosphate ester amine salt represented by the following formula (1):

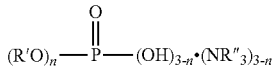

(1)

in which n is an integer of 1 or 2, R' is a linear alkyl group having 4 to 6 carbon atoms, and R" is a hydrogen atom or an alkyl group having 11 to 14 carbon atoms.

Here, R' represents a linear alkyl group having 4 to 6 carbon atoms, and R" represents a hydrogen atom or a linear or branched alkyl group having 11 to 14 carbon atoms. At least one of the three R"s is preferably a linear alkyl group or branched alkyl group having 11 to 14 carbon atoms.

The acid phosphate ester amine salt (B) may have one or two hydroxy groups because n is an integer of 1 or 2. When there is one hydroxy group, there are two-OR' groups, and when there are two hydroxy groups, there is one-OR' group. The acid phosphate ester amine salt (B) may be a mixture of the acid phosphate ester amine salt represented by the formula (1) in which n is 1 and the acid phosphate ester amine salt represented by the formula (1) in which n is 2, and these may be used alone.

R' represents a linear alkyl group having 4 to 6 carbon atoms. In a case where the number of carbon atoms of R' is out of the range of 4 to 6, sufficient lubricity (anti-wear property) may not be obtained. In addition, in a case where the alkyl group is a branched alkyl, oxidation stability in the presence of seawater may deteriorate. From this viewpoint, R' is most preferably a linear alkyl group having 6 carbon atoms (i.e., a hexyl group). Therefore, the acid phosphate ester amine salt (B) represented by the formula (1) is preferably an amine salt of monohexyl phosphate or an amine salt of dihexyl phosphate, and it is more preferable to use both of them in combination.

R" is a hydrogen atom or a linear or branched alkyl group having 11 to 14 carbon atoms. When the number of carbon atoms of R" is 10 or less, the solubility in a lubricating oil is reduced, and therefore, precipitation may occur at low temperature when blended. On the other hand, when the number of carbon atoms of R" is 15 or more, sufficient lubricity (anti-wear property) or rust preventive property may not be obtained. From this viewpoint, the number of carbon atoms of R" is more preferably 12 to 13.

The lubricating oil composition of the present invention contains 0.1 to 1.5 parts by mass of the acid phosphate ester amine salt (B) with respect to 100 parts by mass of the ester compound (A). When the content of the acid phosphate ester amine salt (B) is less than 0.1 parts by mass, sufficient lubricity (anti-wear property) or rust preventive property may not be obtained. On the other hand, when the content of the acid phosphate ester amine salt (B) exceeds 1.5 parts by mass, toxicity and accumulation to aquatic organisms increase, and oxidation stability in the presence of seawater may deteriorate. From this viewpoint, the content of the acid phosphate ester amine salt (B) is preferably 0.2 to 1.25 parts by mass, and more preferably 0.3 to 1.00 parts by mass.

< (C) Succinic Acid Monoester>

The lubricating oil composition of the present invention contains (C) a succinic acid monoester which is a monoesterified product of succinic acid having a hydrocarbon group having 8 to 18 carbon atoms and an alkanediol having 3 to 8 carbon atoms. Succinic acid having a hydrocarbon group having 8 to 18 carbon atoms is a compound in which a hydrocarbon group having 8 to 18 carbon atoms is added to succinic acid, which is known as a succinic acid derivative. In the present invention, when succinic acid having a hydrocarbon group having less than 8 or more than 18 carbon atoms is used, sufficient rust prevention performance may not be obtained. The succinic acid having a hydrocarbon group having 8 to 18 carbon atoms is preferably succinic acid having a hydrocarbon group having 8 to 16 carbon atoms, more preferably succinic acid having a hydrocarbon group having 10 to 14 carbon atoms, and most preferably succinic acid having a hydrocarbon group having 12 carbon atoms. The succinic acid having a hydrocarbon group having 12 carbon atoms is preferably dodecylsuccinic acid or dodecenylsuccinic acid.

As the alkanediol having 3 to 8 carbon atoms to be reacted with the succinic acid having a hydrocarbon group having 8 to 18 carbon atoms, the alkane having 3 to 8 carbon atoms may be linear or branched. In addition, the position of the hydroxy group is not particularly limited. In the present invention, preferable alkanediol is alkanediol having 3 to 6 carbon atoms, more preferable is propanediol or butanediol having 3 to 4 carbon atoms, and most preferable is 1,2-propanediol.

The succinic acid monoester (C) in the present invention may be a monoesterified product obtained by reacting succinic acid having a hydrocarbon group having 8 to 18 carbon atoms with an alkanediol having 3 to 8 carbon atoms. Alternatively, the succinic acid monoester (C) may be a monoesterified product obtained by adding a hydrocarbon group having 8 to 18 carbon atoms to a monoester obtained by reacting succinic acid and an alkanediol having 3 to 8 carbon atoms in advance. In the case of a diester, sufficient rust prevention performance may not be obtained. In addition to the monoesterified product, a diesterified product may be further mixed.

The lubricating oil composition of the present invention contains 0.01 to 0.25 parts by mass of the succinic acid monoester (C) with respect to 100 parts by mass of the ester compound (A). When the content of the succinic acid monoester (C) is less than 0.01 parts by mass, sufficient rust prevention performance may not be obtained. On the other hand, when the content of the succinic acid monoester (C) exceeds 0.25 parts by mass, toxicity and accumulation to aquatic organisms increase, sufficient lubricity (anti-wear property) may not be obtained, and oxidation stability in the presence of seawater may deteriorate. From this viewpoint, the content of the succinic acid monoester (C) is preferably 0.02 to 0.20 parts by mass, and more preferably 0.05 to 0.15 parts by mass.

< (D)N-Oleoylsarcosine>

Further, the lubricating oil composition of the present invention contains (D)N-oleoylsarcosine. In the present invention, the N-oleoylsarcosine (D) is contained in an amount of 0.01 to 0.25 parts by mass with respect to 100 parts by mass of the ester compound (A). When the content of the N-oleoylsarcosine (D) is less than 0.01 parts by mass, sufficient rust prevention performance may not be obtained. On the other hand, when the content of the N-oleoylsarcosine (D) exceeds 0.25 parts by mass, toxicity and accumulation to aquatic organisms increase, and sufficient lubricity (anti-wear property) may not be obtained. From this viewpoint, the content of the N-oleoylsarcosine (D) is preferably 0.02 to 0.20 parts by mass, and more preferably 0.05 to 0.15 parts by mass.

<Additives Other than (A) to (D)>

The lubricating oil composition of the present invention may contain, in addition to the ester compound (A), the acid phosphate ester amine salt (B), the succinic acid monoester (C), and the N-oleoylsarcosine (D), a known lubricating oil additive, if necessary, in order to further enhance the performance thereof. As the additive, a metal deactivator, an antioxidant, an antifoaming agent, a pour point depressant, and a viscosity index improver may be appropriately mixed with the above-described ester compound, if desired, in an amount that does not impair the object of the present invention. These additives may be used alone or in combination of two or more kinds thereof.

Examples of the metal deactivator include benzotriazole or a derivative thereof and thiazole or a derivative thereof. These metal deactivators may be used alone or in combination of two or more thereof.

The content of the metal deactivator is preferably 0.001 to 0.1 parts by mass, more preferably 0.002 to 0.08 parts by mass, and still more preferably 0.003 to 0.06 parts by mass, with respect to 100 parts by mass of the ester compound (A).

As the antioxidant, a phenol-based antioxidant, an amine-based antioxidant, and a sulfur-based antioxidant can be used, and a phenol-based antioxidant and an amine-based antioxidant can be more preferably used.

As the phenol-based antioxidant, for example, 2,6-di-t-butylparacresol, 4,4-methylenebis(2,6-di-t-butylphenol), 4,4-thiobis(2-methyl-6-t-butylphenol), 4,4-bis(2,6-di-t-butylphenol), pentaerythritol tetrakis [3-(3,5-di-tert-butyl-4-hydroxyphenyl) propionate] can be preferably used, and pentaerythritol tetrakis [3-(3,5-di-tert-butyl-4-hydroxyphenyl) propionate] is particularly preferable.

As the amine-based antioxidant, for example, phenyl-α-naphthylamine, phenyl-β-naphthylamine, alkylphenyl-α-naphthylamine, alkylphenyl-β-naphthylamine, bis(alkylphenyl)amine, phenothiazine, monooctyldiphenylamine, 4,4'-bis(α,α-dimethylbenzyl)diphenylamine, 2,2,4-trimethyl-1,2-dihydroquinoline or a polymer thereof, 6-methoxy-2,2,4-trimethyl-1,2-dihydroquinoline or a polymer thereof, and 6-ethoxy-2,2,4-trimethyl-1,2-dihydroquinoline or a polymer thereof can be preferably used, and phenyl-α-naphthylamine, phenyl-β-naphthylamine, alkylphenyl-α-naphthylamine, alkylphenyl-β-naphthylamine, and 2,2,4-trimethyl-1,2-dihydroquinoline or a polymer thereof are more preferably used.

Further, the oxidation stability of the lubricating oil composition of the present invention is further improved by using the phenol-based antioxidant and the amine-based antioxidant in combination.

The content of the antioxidant is preferably 0.1 to 5.0 parts by mass, more preferably 0.2 to 4.0 parts by mass, and still more preferably 0.5 to 3.0 parts by mass, with respect to 100 parts by mass of the ester compound (A).

Examples of the antifoaming agent include silicone-based compounds.

The lubricating oil composition of the present invention can be produced by blending the ester compound (A), the acid phosphate ester amine salt (B), the succinic acid monoester (C), and the N-oleoylsarcosine (D) each in a predetermined amount, and if necessary, blending the above-mentioned various additives. The method of blending, mixing, and adding the respective additives is not particularly limited, and various methods can be adopted. The order of blending, mixing, and adding the respective additives is not particularly limited, and various methods can be adopted. For example, a method in which various additives are directly added to the ester compound (A) and mixed by heating, or a method in which a high-concentration solution of additives is prepared in advance and these are mixed with the ester compound (A) may be used.

EXAMPLES

Hereinafter, the present invention will be more specifically described with reference to Examples and Comparative Examples.

Synthesis of Ester Compound

Synthesis Example 1

Into a 5 L four-necked flask equipped with a thermometer, a nitrogen inlet tube, a stirrer, and a cooling tube, 545 g (4.06 mol) of trimethylolpropane and 2955 g (10.60 mol) of industrial oleic acid NAA-34 (manufactured by NOF Corporation, unsaturated acid content: 90% by mass) were charged, and reacted at normal pressure while removing water of reaction under a nitrogen stream at 240° C. until the acid value became 0.5 mgKOH/g or less.

Thereafter, the reactor was cooled to 85° C., and 1.5 equivalents of sodium hydroxide calculated from the acid value was diluted with ion-exchanged water to prepare a 10% by mass aqueous solution, which was added to the reaction solution and stirred for 1 hour. After stirring was stopped, the mixture was allowed to stand for 30 minutes, and the aqueous layer separated in the lower layer was removed.

Next, ion-exchanged water was added in an amount corresponding to 20% by mass of the reaction solution, and the mixture was stirred at 85° C. for 10 minutes, left to stand for 15 minutes, and the separated aqueous layer was removed. This operation was repeated 5 times, followed by dehydration by stirring at 100° C. and 30 Torr for 1 hour.

Finally, activated clay was added in an amount corresponding to 2% by mass of the reaction solution, and the mixture was stirred for 1 hour under the conditions of 80° C. and 30 Torr and filtered to remove the adsorbent, thereby obtaining an ester compound A1.

Synthesis Example 2

Into a 5 L four-necked flask equipped with a thermometer, a nitrogen inlet tube, a stirrer, and a cooling tube, 320 g (2.38 mol) of trimethylolpropane, 137 g (1.01 mol) of pentaerythritol, and 3019 g (10.85 mol) of industrial oleic acid NAA-34 (manufactured by NOF Corporation, unsaturated acid content: 90% by mass) were charged, and reacted at normal pressure while removing water of reaction under a nitrogen stream at 240° C. until the acid value became 0.5 mgKOH/g or less.

Thereafter, the reactor was cooled to 85° C., and 1.5 equivalents of sodium hydroxide calculated from the acid value was diluted with ion-exchanged water to prepare a 10% by mass aqueous solution, which was added to the reaction solution and stirred for 1 hour. After stirring was stopped, the mixture was allowed to stand for 30 minutes, and the aqueous layer separated in the lower layer was removed.

Next, ion-exchanged water was added in an amount corresponding to 20% by mass of the reaction solution, and the mixture was stirred at 85° C. for 10 minutes, left to stand for 15 minutes, and the separated aqueous layer was removed. This operation was repeated 5 times, followed by dehydration by stirring at 100° C. and 30 Torr for 1 hour.

Finally, activated clay was added in an amount corresponding to 2% by mass of the reaction solution, and the mixture was stirred for 1 hour under the conditions of 80° C. and 30 Torr and filtered to remove the adsorbent, thereby obtaining an ester compound A2.

Regarding the ester compounds A1 and A2 obtained above, the measurement results of the acid value, the hydroxyl value, the kinematic viscosity at 40° C., the kinematic viscosity at 100° C., the viscosity index, the flash point, and the pour point are shown in Table 1.

TABLE 1

| | Ester compound | A1 | A2 |
|---|---|---|---|
| Physical property values | Acid value (mgKOH/g) | 0.1 | 0.1 |
| | Hydroxyl value (mgKOH/g) | 16 | 5 |
| | Kinematic viscosity at 40° C. ($mm^2/s$) | 46.2 | 54.6 |
| | Kinematic viscosity at 100° C. ($mm^2/s$) | 9.3 | 10.5 |
| | Viscosity index | 190 | 187 |
| | Flash point (° C., the COC method) | 290 | 322 |
| | Pour point (° C.) | −30 | −35 |

Examples 1 to 5 and Comparative Examples 1 to 5

Preparation of Lubricating Oil Composition

The ester compounds A1 and A2 obtained above were blended with additives according to the following procedure to prepare lubricating oil compositions of Examples 1 to 5 and Comparative Examples 1 to 5.

The following additives were added to the ester compounds A1 and A2 synthesized above in the blending amounts shown in Table 2 in a 3 L four-necked flask equipped with a thermometer, a nitrogen inlet tube, a stirrer and a cooling tube, and the mixture was stirred at 120° C. for 2 hours to obtain a lubricating oil composition.

The following additives were used.

<Anti-Wear Agent>

(B) Acid phosphate ester amine salt: (B) Mono dihexyl phosphate·C11-14 branched alkylamine salt (Irgalube 349, manufactured by BASF)·

Compound not corresponding to (B): Branched butyl phosphate· C12-14 branched alkylamine salt (RC 3740, manufactured by LANXESS)

Compound not corresponding to (B): Propanoic acid, bis(2-methylpropoxy)phosphinothioylthio-2-methyl- (Irgalube 353, manufactured by BASF)

<Rust Preventive Agent>

(C) Succinic acid monoester: (C) Monoester of dodecenylsuccinic acid and 1,2-propanediol (Irgacor L12, manufactured by BASF)·

(D)N-Oleoylsarcosine (Eslube AC-01, manufactured by NOF Corporation)·

(4-Nonylphenoxy) acetic acid (Irgacor NPA, manufactured by BASF)

<Amine-Based Antioxidant>

N-[4-(1,1,3,3-tetramethylbutyl)phenyl]-1-naphthylamine (Irganox L 06, manufactured by BASF)

<Phenol-Based Antioxidant>

Pentaerythritol tetrakis [3-(3,5-di-tert-butyl-4-hydroxyphenyl) propionate] (Eslube AO-01, manufactured by NOF Corporation)

<Metal Deactivator>

Benzotriazole derivative (Irgamet 39, manufactured by BASF)

[Evaluation of Lubricating Oil Composition]

The prepared lubricating oil compositions were evaluated as follows, and the results are shown in Table 2.

(Biodegradability Test)

A biodegradability test was conducted in accordance with the OECD301C. Note that the Eco Mark Office of the Japan Environment Association sets the standard for a biodegradable lubricating oil to a biodegradability of 60% or more.

The evaluation was performed according to the following criteria based on the biodegradability.

VG: 70% or more

G: 60% or more and less than 70%

NG: less than 60%

In the description herein, "VG" means "Very Good", "G" means "Good", and "NG" means "Not Good".

(Toxicity and Accumulation to Aquatic Organisms)

A toxicity test against aquatic organisms was conducted in accordance with OECD201, 202, 203. In addition, an accumulation test against aquatic organisms was conducted in accordance with OECD117. In this test, those having EC50 (or LC50)>100 mg/L were accepted in the toxicity test, and those having log Kow<3 or log Kow>7 were accepted passed in the accumulation test.

The evaluation was performed according to the following criteria.

G: Passed both tests

NG: Failed either or both tests (Anti-Wear Property (Shell Four-Ball Wear Test))

In a high-speed Shell four-ball tester, the wear scar diameter (μm) was measured in accordance with ASTM D4172, and the smaller the wear scar diameter (μm), the better the anti-wear property.

The evaluation was performed according to the following criteria based on the wear scar diameter.

VG: less than 400 μm

G: 400 μm or more and less than 500 μm

NG: 500 μm or more (Rust Preventive Property Test)

A lubricating oil rust prevention performance test (artificial seawater) was conducted in accordance with the Japanese Industrial Standards JIS K 2510. The above test usually ends in 24 hours, but in this test, the test was continued until rust was generated.

The evaluation was performed according to the following criteria based on a period until rust was generated.

VG: 7 days or more

G: 1 day or more to less than 7 days

NG: less than 1 day (Oxidation Stability in the Presence of Seawater)

The water in the lubricating oil oxidation stability test (RPVOT) of the Japanese Industrial Standards JIS K 2514-3 (2013) was replaced with artificial seawater, and the oxidation stability in the presence of seawater was measured. The larger the numerical value, the higher the oxidation stability.

The evaluation was performed according to the following criteria based on the oxidation stability.

G: 100 minutes or more

NG: less than 100 minutes

TABLE 2

| | | | Examples | | | | |
|---|---|---|---|---|---|---|---|
| | | | 1 | 2 | 3 | 4 | 5 |
| Type of ester compound | | | A1 | A2 | A1 | A1 | A1 |
| Amount of ester compound (parts by mass) | | | 100 | 100 | 100 | 100 | 100 |
| Additive (parts by mass) | Anti-wear agent | (B) Mono dihexyl phosphate · C11-14 branched alkylamine salt | 0.5 | 1.3 | 0.15 | 0.5 | 0.5 |
| | | Branched butyl phosphate · C12-14 branched alkylamine salt | 0 | 0 | 0 | 0 | 0 |
| | | Propanoic acid, bis(2-methylpropoxy) phosphinothioylthio-2-methyl- | 0 | 0 | 0 | 0 | 0 |
| | Rust preventive agent | (C) Monoester of dodecenylsuccinic acid and 1,2-propanediol | 0.1 | 0.1 | 0.1 | 0.2 | 0.03 |
| | | (D) N-Oleoylsarcosine | 0.1 | 0.1 | 0.1 | 0.2 | 0.03 |
| | | (4-Nonylphenoxy)acetic acid | 0 | 0 | 0 | 0 | 0 |
| | Antioxidant | Phenol-based antioxidant | 2.0 | 2.0 | 2.0 | 2.0 | 2.0 |
| | | Amine-based antioxidant | | | | | |
| | Metal deactivator | Benzotriazole derivative | 0.05 | 0.05 | 0.05 | 0.05 | 0.05 |
| Performance | Biodegradability test | | VG | G | VG | VG | VG |
| | Toxicity and accumulation to aquatic organisms | | G | G | G | G | G |
| | Anti-wear property (μm) | | VG (310) | VG (290) | VG (380) | G (430) | VG (340) |
| | Rust preventive property (artificial seawater) | | VG | G | G | VG | G |
| | Oxidation stability in the presence of seawater (min) | | G (155) | G (144) | G (161) | G (142) | G (130) |

| | | | Comparative Example | | | | |
|---|---|---|---|---|---|---|---|
| | | | 1 | 2 | 3 | 4 | 5 |
| Type of ester compound | | | A1 | A1 | A1 | A2 | A1 |
| Amount of ester compound (parts by mass) | | | 100 | 100 | 100 | 100 | 100 |
| Additive (parts by mass) | Anti-wear agent | (B) Mono dihexyl phosphate · C11-14 branched alkylamine salt | 2.0 | 0 | 0 | 0.5 | 0.5 |
| | | Branched butyl phosphate · C12-14 branched alkylamine salt | 0 | 0.5 | 0 | 0 | 0 |
| | | Propanoic acid, bis(2-methylpropoxy) phosphinothioylthio-2-methyl- | 0 | 0 | 0.5 | 0 | 0 |
| | Rust preventive agent | (C) Monoester of dodecenylsuccinic acid and 1,2-propanediol | 0.1 | 0.1 | 0.1 | 0 | 0.1 |
| | | (D) N-Oleoylsarcosine | 0.1 | 0.1 | 0.1 | 0.1 | 0 |
| | | (4-Nonylphenoxy)acetic acid | 0 | 0 | 0 | 0.1 | 0.1 |
| | Antioxidant | Phenol-based antioxidant | 2.0 | 2.0 | 2.0 | 2.0 | 2.0 |
| | | Amine-based antioxidant | | | | | |
| | Metal deactivator | Benzotriazole derivative | 0.05 | 0.05 | 0.05 | 0.05 | 0.05 |
| Performance | Biodegradability test | | G | VG | VG | G | VG |
| | Toxicity and accumulation to aquatic organisms | | NG | G | G | G | G |
| | Anti-wear property (μm) | | VG (300) | VG (350) | G (450) | NG (510) | NG (530) |
| | Rust preventive property (artificial seawater) | | VG | NG | NG | NG | NG |
| | Oxidation stability in the presence of seawater (min) | | NG (82) | NG (80) | NG (98) | NG (96) | G (115) |

As shown in Examples 1 to 5 of Table 2, it is understood that the lubricating oil composition of the present invention is excellent in biodegradability, lubricity (anti-wear property), and rust preventive property against seawater, low in toxicity and accumulation to aquatic organisms, and excellent in oxidation stability even in the presence of seawater by blending various additives.

On the other hand, in Comparative Example 1, the content of (B) mono dihexyl phosphate·C11-14 branched alkylamine salt is high, and therefore, the toxicity and accumulation to aquatic organisms are high, and the oxidation stability in the presence of seawater is low.

In Comparative Example 2, since the branched butyl phosphate C12-14 branched alkylamine salt was contained instead of the (B) mono dihexyl phosphate·C11-14 branched alkylamine salt, the rust preventive property and the oxidative stability in the presence of seawater of the lubricating oil composition were low.

In Comparative Example 3, since the propanoic acid, bis(2-methylpropoxy)phosphinothioylthio-2-methyl—was contained instead of the (B) mono dihexyl phosphate·C11-14 branched alkylamine salt, the rust preventive property and the oxidative stability in the presence of seawater of the lubricating oil composition were low.

In Comparative Example 4, since (4-nonylphenoxy) acetic acid was contained instead of the (C) monoester of dodecenylsuccinic acid and 1,2-propanediol, the lubricity (anti-wear property), the rust preventive property, and the oxidation stability in the presence of seawater of the lubricating oil composition were low.

In Comparative Example 5, since (4-nonylphenoxy) acetic acid was contained instead of the (D)N-oleoylsarcosine, the lubricity (anti-wear property) and the rust preventive property of the lubricating oil composition were low.

The invention claimed is:

1. A lubricating oil composition comprising, per 100 parts by mass of the following (A) an ester compound, 0.1 to 1.5 parts by mass of (B) an acidic phosphate ester amine salt, 0.01 to 0.25 parts by mass of (C) a succinic acid monoester, and 0.01 to 0.25 parts by mass of (D)N-oleoylsarcosine:

(A): an ester compound of a neopentyl polyol having 5 to 10 carbon atoms and a valence of alcohol of 2 to 6 and a linear unsaturated fatty acid having 16 to 22 carbon atoms;

(B): an acidic phosphate ester amine salt represented by the following formula (1)

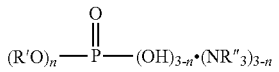

(1)

wherein n is an integer of 1 or 2, R' is a linear alkyl group having 4 to 6 carbon atoms, and R" is a hydrogen atom or an alkyl group having 11 to 14 carbon atoms;

(C) a succinic acid monoester which is a monoesterified product of a succinic acid having a hydrocarbon group having 8 to 18 carbon atoms and an alkanediol having 3 to 8 carbon atoms.

* * * * *